United States Patent [19]

Holz et al.

[11] Patent Number: 4,555,142

[45] Date of Patent: Nov. 26, 1985

[54] SUPPLY OF LIQUID MEDIA FOR A HYDRAULIC-MECHANICALLY OPERATING MINE WORKING MACHINE WITH SWORD

[75] Inventors: Joachim Holz, Dortmund; Wolfgang Meier, Oer-Erkenschwick; Karl-Heinz Schwarting, Voerde; Heinrich Goris, Hamminkeln; Kurt Ogorek, Oberhausen, all of Fed. Rep. of Germany

[73] Assignee: M.A.N. Maschinenfabrik Augsburg-Nürnberg AG, Fed. Rep. of Germany

[21] Appl. No.: 559,764

[22] Filed: Dec. 9, 1983

[30] Foreign Application Priority Data

Dec. 10, 1982 [DE] Fed. Rep. of Germany ..... 3245792

[51] Int. Cl.[4] ..... E21C 35/12; E21C 35/22

[52] U.S. Cl. ..... 299/43; 299/81; 299/34

[58] Field of Search ..... 299/42, 43, 34, 81

[56] References Cited

U.S. PATENT DOCUMENTS

| | | | |
|---|---|---|---|
| 4,063,782 | 12/1977 | Bähre et al. | 299/34 X |
| 4,251,110 | 2/1981 | Beckmann et al. | 299/43 |

FOREIGN PATENT DOCUMENTS

| | | | |
|---|---|---|---|
| 1277174 | 9/1968 | Fed. Rep. of Germany | 299/34 |
| 2250535 | 4/1974 | Fed. Rep. of Germany | 299/34 |
| 616405 | 7/1978 | U.S.S.R. | 299/34 |

*Primary Examiner*—Stephen J. Novosad
*Assistant Examiner*—Michael Goodwin
*Attorney, Agent, or Firm*—McGlew and Tuttle

[57] ABSTRACT

A hydraulic-mechanically operating mine working machine includes a multi-part sword engaging a mine longwall conveyor from below. The machine is pulled by a traction rig disposed on the stowing side of the longwall conveyor, which is supplied from the drift with the liquid media needed for cutting and for control purposes via drag lines accommodated in a special duct on the stowing side. The connection between the drag lines arriving on the stowing side and the working machine at the adit end is established by way of a hose hookup block connected with the tractor hookup block, the tractor hookup block and the sword of the working machine engaging the longwall conveyor from below.

8 Claims, 6 Drawing Figures

SUPPLY OF LIQUID MEDIA FOR A HYDRAULIC-MECHANICALLY OPERATING MINE WORKING MACHINE WITH SWORD

FIELD AND BACKGROUND OF THE INVENTION

This invention relates in general to mining machines and in particular to a new and useful hydraulically and mechanically operated mine working machine, which has a multi-part sword engages below a longwall conveyor and includes the sword underlying the conveyor which extends into a tractor duct and a dragline duct and has a tractor hookup bar portion connected to the traction cable and a hose hookup lock connected to the media supply lines.

The invention relates particularly to a hydraulic-mechanically operating mine working machine with a multi-part sword engaging the longwall conveyor from below, which machine is pulled by a traction device disposed on the stowing side of the longwall conveyor, and which is supplied from the drift with liquid media needed for cutting and for control purposes, through drag lines accomodated in a special duct on the stowing side.

The use of working machines for mining veins of small thickness brings up many problems. This is true also of working machines operated hydraulic-mechanically, that is, where the mineral is cut by means of high-pressure liquid jets and is then broken by mechanical crushers. Such machines must have, firstly, a compact form, and secondly all equipment for the liquid media needed for cutting the mineral and for controlling the cutting and breaking tool required for carrying out the work processes must be accomodated in the body of the machine.

It is the object of the invention to supply the necessary liquids media to a hydraulic-mechanically operating working machine with sword, to be used in particular in longface mining of shallow veins, in such a way that the media-carrying lines are brought to the working machine over the sword from the drag line duct on the stowing side of the longwall conveyor as a compact unit, requiring little maintenance, and under optimum conditions of safety. The known method of bringing the drag lines to the working machine via a portal extending over the longwall conveyor must be ruled out, as this construction is not usable for shallow veins because of its height.

SUMMARY OF THE INVENTION

The invention establishes a connection between the drag lines arriving on the stowing side and the working machine at the adit end by way of a hose hookup block connected with the tractor hookup block and sword of the working machine engaging the longwall conveyor from below.

The invention comprises a hydraulically and mechanically operating mine working machine with a multi part sword which engages a longwall conveyor from below. The machine is pulled by an element tractor in the form of a drag cable, which is disposed on the stowing side of a longwall conveyor, which is supplied from the drift with a high-pressure liquid media needed for cutting and control purposes through drag lines which are accomodated in a special duct on the stowing side. The connection between the drag lines arriving at the stowing side in the working machine at the adit end is established by way of a hose hookup block connected to a tractor hookup block which is provided as part of the sword which engages the longwall conveyor from below.

The connection system according to the invention represents a design which is easy to follow, to repair and to service, and which, in particular, is safe. It is safe both as to the operation of the equipment itself and for the miners present in the longwall, protecting them from any leakage of high-pressure liquid media. To the extent possible, the various controls, etc. of the system are designed so as to be uniform and interchangeable.

Accordingly, it is an object of the invention to provide an improved mining machine, which has a sword with both a traction connection block and a hose connection block portion, which ride in a tractor duct and a drag line duct provided on the stowage side of the longwall conveyor.

A further object of the invention is to provide a mining machine which is simple in design rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

GENERAL DESCRIPTION OF THE PREFERRED EMBODIMENT

Figure 1:
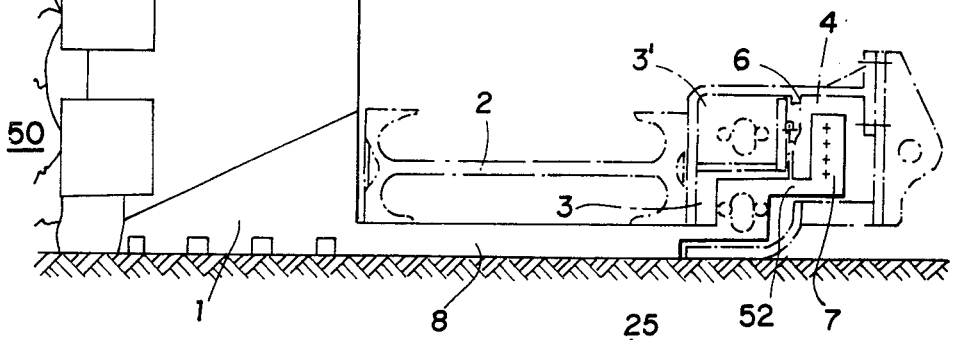
FIG. 1 is a transverse section of a mining device having the equipment of the invention next to a longwall.

Referring to the drawings in particular the invention embodied therein comprises mine apparatus which includes a working machine 1 that is movable along a longwall 50 and which has a sword portion 8 extending at a spaced location from the longwall and underlying a longwall conveyor 2. The device includes means defining separate upper and lower tractor ducts 3' and 3 alongside a drag line duct 4 with a communicating slot 52 being defined between the drag line duct 4 and the lower one of the tractor ducts 3. Hose hookup blocks 7 are movable in drag line duct 4 and extend into the lower one of the tractor ducts 3. High pressure cutting liquids media carrying lines 5 and a tractor block 14, carrying a yoke member 13, are connected to each block 7. Each yoke member 13 is connected to tractor cables or lines 25. Ducts 3,3' are on a stowing side of the longwall conveyor 2.

The working machine 1 is moved back and forth parallel to the longwall conveyor 2 along longwall 50 by the tractor cables or lines 25 which run in tractor duct 3. Duct 3 is a load track and 3' an empty track. Next to the tractor ducts 3 and 3' is the duct 4 for supply elements or media-carrying lines 5. The longitudinal slot 52 between duct 3 for the load track and duct 4 for the drag line is sealed by a pivotable locking device 6. The hose hookup block 7, where the drag lines 5 are connected, is located in the duct 4.

The sword 8 of the working machine 1 engages the longwall conveyor 2 from below.

Figure 2:
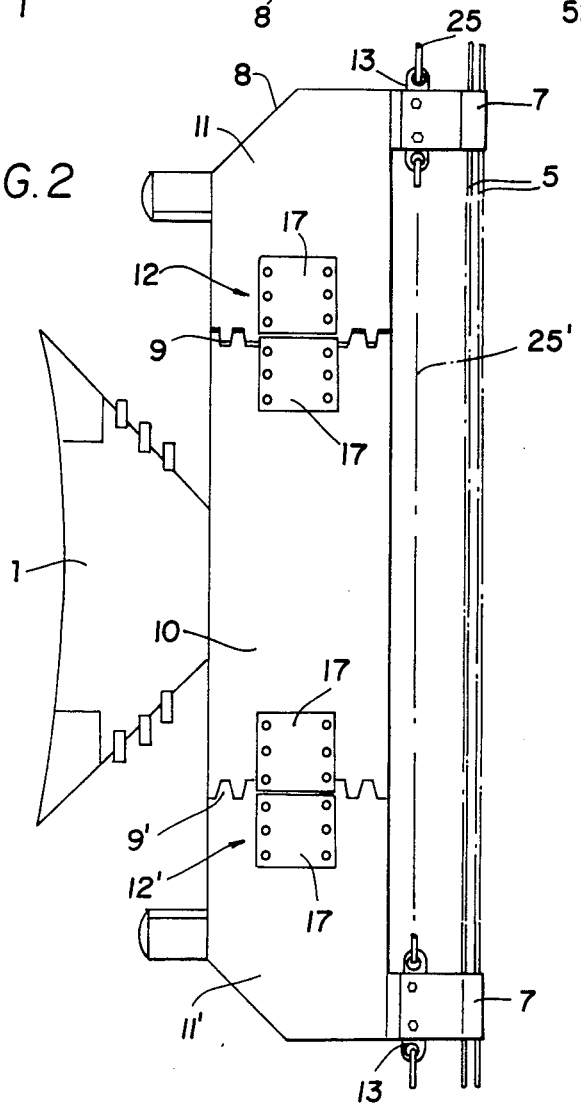
FIG. 2 is a plan view of the working machine and its sword.

FIG. 2 shows the working machine 1 and the sword 8 attached to it. By hinges 9 and 9' the sword is divided into a first central part 10 for carrying the cutting hook and two second front parts 11 and 11'. The division facilitates adaptation to an uneven floor.

In the region of the median axis of the sword 8, cutouts 12 and 12' are provided on either side of hinges 9 and 9'.

Figure 3:
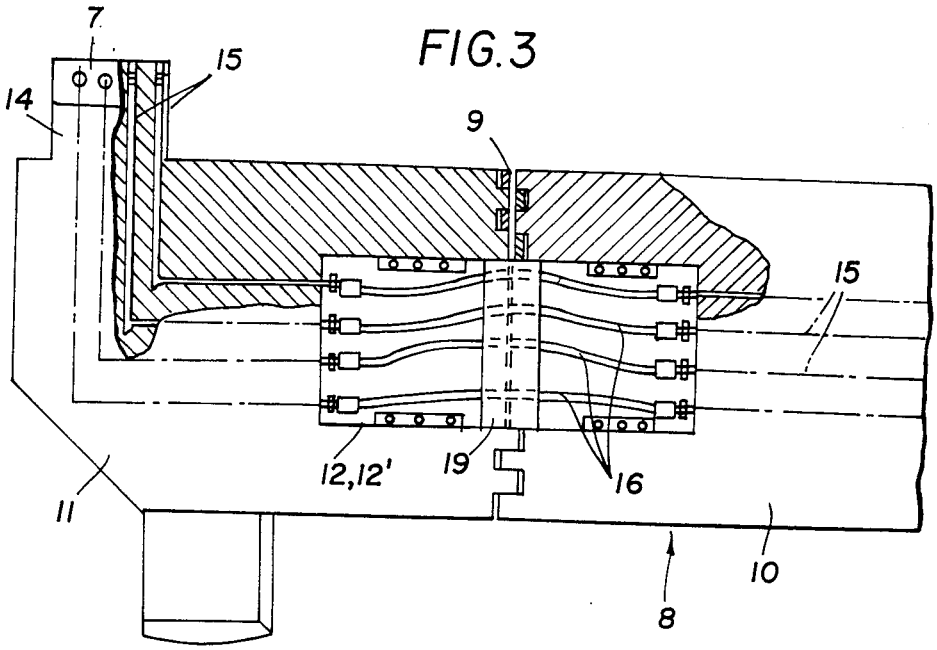
FIG. 3 is a partial plan and partial elevational view of a connection point of the front and central portions of the sword.
Figure 4:
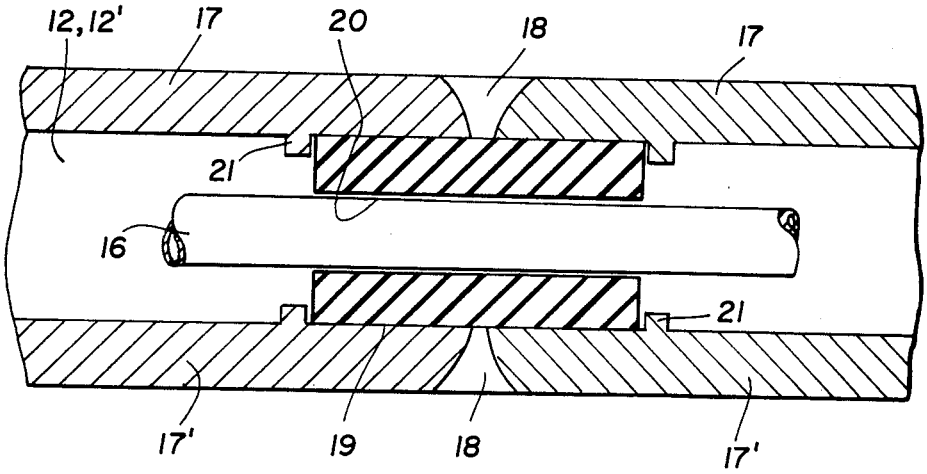
FIG. 4 is a partial transverse section of the arrangement according to FIG. 3.

The media-carrying lines 5 extending through the hose hookup block 7 communicate with the tractor hookup block 14 through bores 15 and continue in the sword 8 (dash-dot lines in FIG. 3), and then in the central part 10 of the sword 8, to the working machine 1. As can be seen in FIG. 3, the bores 15 approach the edge of the cutouts 12 and 12' inside the sword. Inside the cutouts 12 and 12', the bores 15, matching between the front portion 11 and central portion 10 as well as between front portion 11' and central portion 10 of the sword 8, are connected by flexible hoses 16.

The cutouts 12 and 12' are closed from the top and bottom by covers 17 and 17' extending up to the axis of the hinges 9. The covers 17 and 17' leave free on the top and bottom sides a gap 18 for an angle bend which occurs due to an uneven floor. In the region of the hinges 9. A filler piece 19 of flexible material is inserted between the upper and lower covers 17, 17'. The filler piece 19 has recesses 20 for the passage of the hoses 16 and is fixed by stops 21 of the covers 178 and 17'.

Figure 5:
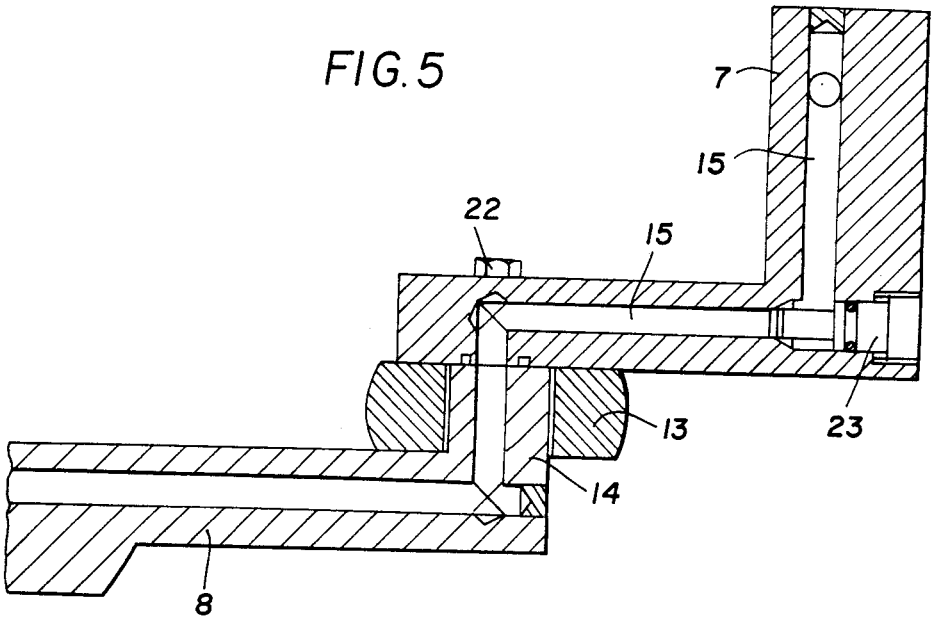
FIG. 5 is partial transverse sectional view of FIG. 2 on a larger scale.
Figure 6:
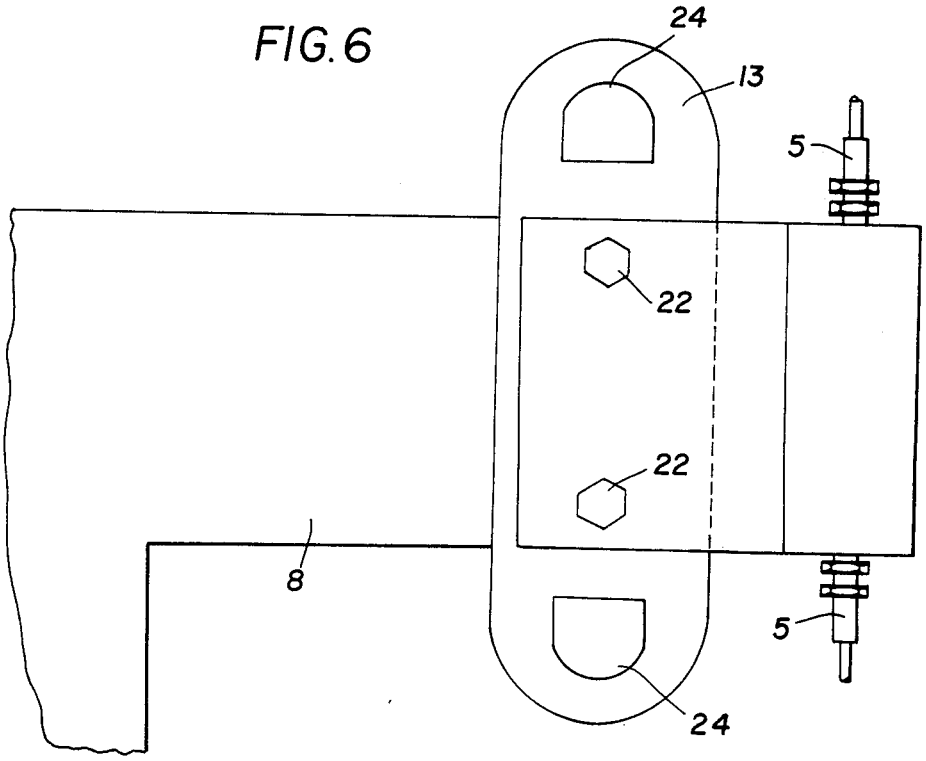
FIG. 6 is a plan view of the tractor hookup element.

As can be seen from FIG. 5, the hose hookup block 7 is screwed to the tractor hookup block 14 and sword 8 by screws 22.

By the screw connection 22 of the hose hookup block 7 to the tractor hookup block 14 at the same time tractor hookup element or yoke 13 is fixed in its position. The tractor hookup element 13 is designed as a wear part at the same time for lateral guiding at the tractor duct walls. At both ends of the tractor hookup element or yoke 13 eyes 24 for attaching the traction means element such as a cable 25, are arranged.

As can be seen from FIG. 5, for each individual bore 15 to the sword 8 a closure element 23 is provided at the hose hookup block 7.

As can be seen from FIG. 2, a traction element connection or chain 25' exists between the two tractor hookup elements or yokes 13 between the front portions 11 and 11' of the sword. This chain 25' is not under tension; it serves only as a safety device in case the hinges 9 of the sword 8 should break.

A liquid media may be supplied from the dragline duct 4 over only one tractor hookup block 7, or, as is appropriate for a plurality of media-carrying lines, over both tractor hookup blocks 14 present at the front portions 11 and 11' of the sword.

While specific embodiments of the invention have been shown and described in detail to illustrate the application of the principles of the invention, it will be understood that the invention may be embodied otherwise departing from such principles.

What is claimed is:

1. A mine apparatus for use with a longwall conveyor having a stowing side facing away from a longwall to be mined, comprising:

a working machine (1) movable along a longwall (50) and having a sword (8) with a first part (10) carrying cutting tools to cut the longwall, and at least one second part (11) having a tractor hookup block (14) with a plurality of bores (15) therein for supplying high pressure liquid medium to said cutting tools for cutting and control purposes, said first and second part being shaped to receive a longwall conveyor thereon and being connected to each other for relative movement therebetween;

duct means defining separate upper and lower tractor ducts (3, 3') and a drag line duct (4) extending parallel to each other and at a stowing side of a longwall conveyor, said duct means including a slot (52) communicating said drag line duct with said lower tractor duct, said tractor hookup block being movable in said lower tractor duct;

tractor means (13,25) movable in said lower tractor duct and connected to said tractor hookup block for pulling said tractor hookup block and said sword back and forth along the longwall;

a hose hookup (7) which is separate from said tractor hookup block (14), fixedly connected to said tractor hookup block, said hose hookup block movable in said drag line duct (4) and extending through said slot for connection to said tractor hookup block, said hose hookup block having a plurality of bores (15) communicating respectively with said bores of said tractor hookup block; and a plurality of high pressure liquid media carrying lines (5) connected to said hose hookup block (7) and movable in and confined by said drag line duct for supplying high pressure liquid media to said bores and to said cutting tools for cutting and control purposes.

2. A mine apparatus according to claim 1, wherein each of said first and second parts of said sword have cutouts (12) therein, adjacent a connection between said first and second parts, said second part having a plurality of bores respectively connected to said bores of said tractor hookup block, said first part having a plurality of bores corresponding in number to said plurality of bores of said second part, and a plurality of flexible hoses (16) connected between respective bores of said first and second parts, said cutouts of said first and second parts being adjacent each other and said hoses disposed in said adjacent cutouts, said connection between said first and second parts comprising a hinge connection.

3. A mine apparatus according to claim 2, including at least one cover (17) over each cutout of each of said first and second parts, said covers of said first and second parts defining a gap therebetween for permitting relative movement between said first and second parts.

4. A mining apparatus according to claim 3, including a resilient material filler piece (19) engaged over said hoses and in said adjacent cutouts at an area of said hinge, said filler part being at least partly engaged by said covers of said first and second parts.

5. A mining apparatus according to claim 4, wherein each of said covers includes a stop (21) extending into a respective cutout (12) of said first and second parts and engaged with said filler piece (19) for holding said filler piece in a fixed position in said communicating recesses.

6. A mining apparatus according to claim 1, wherein said tractor hookup block has an upwardly extending portion connected to said hose hookup block, said tractor means comprising a yoke (13) engaged around said upwardly extending portion of said tractor hookup block (14) for guiding said tractor hookup block with respect to said lower tractor duct.

7. A mining apparatus according to claim 6, wherein said hose hookup block is screwed to said upwardly extending portion of said tractor hookup block over said yoke.

8. A mine apparatus according to claim 7, wherein one bore through said hose hookup block has an opening extending out of said hose hookup block with a closure element (23) fixed in and closing said opening.

* * * * *